United States Patent [19]

Yoshino

[11] 4,235,195

[45] Nov. 25, 1980

[54] LIQUID DEVELOPMENT APPARATUS

[75] Inventor: Masahiro Yoshino, Atsugi, Japan

[73] Assignee: Ricoh Company, Ltd., Japan

[21] Appl. No.: 937,130

[22] Filed: Aug. 28, 1978

[30] Foreign Application Priority Data

Aug. 30, 1977 [JP] Japan ..... 52/104058

[51] Int. Cl.[3] ..... G03G 13/10; G03D 3/04

[52] U.S. Cl. ..... 118/662; 118/660; 118/612; 355/10; 354/317; 430/117

[58] Field of Search ..... 118/659, DIG. 23, 660, 118/410, 412, DIG. 4, 662; 354/317; 355/10; 427/17

[56] References Cited

U.S. PATENT DOCUMENTS

| | | | |
|---|---|---|---|
| 3,369,918 | 2/1968 | Young | 427/17 |
| 3,916,829 | 11/1975 | Yamada et al. | 118/DIG. 23 |
| 3,943,541 | 3/1976 | Hirafuji | 355/10 |
| 4,006,709 | 2/1977 | Miyakawa et al. | 118/DIG. 23 |
| 4,110,029 | 8/1978 | Goshima | 118/659 |

*Primary Examiner*—Mary F. Downey
*Assistant Examiner*—John L. Goodrow
*Attorney, Agent, or Firm*—McGlew and Tuttle

[57] ABSTRACT

The development apparatus of a developer impingement type comprises a developer distributor having a developer impingement outlet for injecting a liquid developer against the surface of a photoconductor member having a latent electrostatic image thereon, and a developer inlet for introducing the liquid developer into the developer distributor, and a coil shaped buffer member disposed between the developer injection outlet and the developer inlet, extending along the developer impingement outlet which covers an image area of the photoconductor member with a predetermined space from the surface of the photoconductor member.

21 Claims, 3 Drawing Figures

LIQUID DEVELOPMENT APPARATUS

BACKGROUND OF THE INVENTION

The present invention relates to a development apparatus for developing latent electrostatic images formed on a photoconductor by use of a liquid developer in an electrophotographic copying apparatus, and more particularly to a development apparatus for developing latent electrostatic images formed on a photoconductor by causing a liquid developer to impinge upon the surface of the photoconductor.

As a development apparatus for use with an electrophotographic copying apparatus, such a development apparatus comprising a liquid developer container and a liquid developer distributor is known, wherein a liquid developer is fed into the liquid developer distributer by a pump means from the liquid developer container, and the liquid developer is impinged against the surface of the photoconductor from an impingement outlet of the liquid developer distributor, so that a latent electrostatic image is developed by a direct impingement of the liquid developer against the photoconductor.

Conventionally, in such a development apparatus, the impingement outlet of the liquid developer distributor comprises a plurality of orifices formed in the axial direction of a latent electrostatic image bearing photoconductor drum, namely in the longitudinal direction of the liquid developer distributor, or with a space placed between the respective orifices, or a slit extending in the longitudinal direction of the liquid developer distributor. However, in such liquid developer distributor, since only one or two developer inlets for introducing the liquid developer into the liquid developer distributor are formed, as the developer becomes more distant from the inlets, the flow rate of the developer gradually decreases, so that a uniform distribution of the flow rate of the developer in the longitudinal direction of the liquid developer distributor cannot be obtained. Such an ununiform flow rate of the developer, if any, will bring about an ununiform concentration of the developer and accordingly an ununiform development. Furthermore, since the flow rate of the developer is comparatively high around the impingement outlets closely adjacent the developer inlets, there is a risk that an insufficient development is locally caused in an area where the developer is directly impinged on the surface of the photoconductor drum due to a washing action of the impinged liquid developer. In order to eliminate the above-mentioned shortcomings, namely, in order to improve the ununiform distribution of the flow rate of the liquid developer in some conventional development apparatus, there are disposed a buffer plate before the developer impingement outlet. However, in practice, it is difficult to improve the ununiform distribution of the flow rate of the developer by such a buffer plate, and there is a risk that the buffer plate damages some good characteristics of the developer impingement type development apparatus.

Furthermore, in order to improve the uneven distribution of the flow rate of the developer, it has been devised to dispose a developer buffer member between the developer inlets and the developer outlets of the developer distributor, and various buffer members have been devised to accomplish the above-mentioned object. Of the various buffer members, a net-buffer member is known as the most effective. As a matter of fact, by use of the net-buffer member, the flow rate of the developer from the developer impingement outlet can be made uniform, so that uneven development or locally insufficient development can be eliminated. However, since the meshes of the net are so small that the net is apt to be clogged while in use by the developer, and this results in the distribution of the liquid developer becoming uneven.

SUMMARY OF THE INVENTION

It is therefore a principal object of the present invention to provide an improved developer impingement type development apparatus which permits uniform impingement of developer on latent electrostatic images formed on a photoconductor drum so as to obviate locally insufficient and ununiform development.

In the present invention, the development apparatus comprises a developer distributor having both an impingement outlet for impinging a developer against latent images formed on a photoconductor drum and a developer inlet for introducing the developer into the developer distributor from a developer container, and a coil buffer member extending in the longitudinal direction of the developer distributor, which is disposed between the developer inlet and the developer outlet. The coil buffer member, made of a coil spring and assembled in the developer distributor, forms meshes, viewed from the flow direction of the developer. Therefore, the flow of the developer is made uniform while the developer passes through the coil buffer member. Furthermore, since the coil buffer member is flexible, there is no risk that the meshes are clogged by the developer, whereby a stable and uniform flow of the developer is accomplished.

DETAILED DESCRIPTION OF THE PREFERRED EMBODIMENTS

Figure 1:
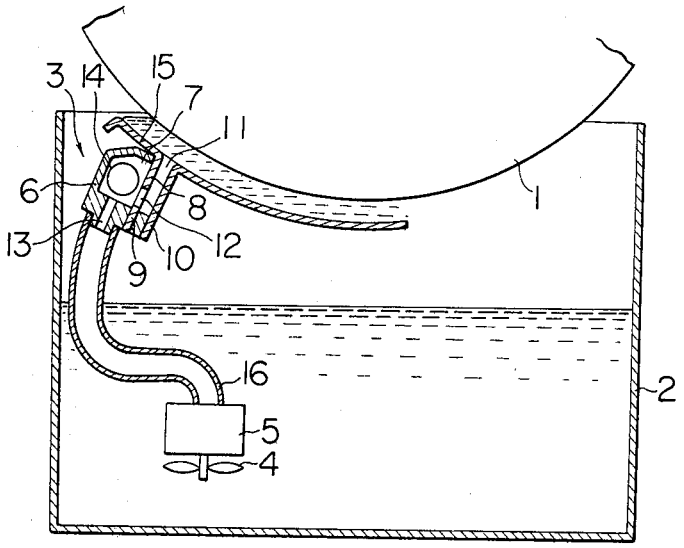
FIG. 1 is a schematic sectional side view of an embodiment of a development apparatus according to the present invention.

Referring to FIG. 1, there is shown an embodiment of a development apparatus according to the present invention. The development apparatus is disposed under a photoconductor drum 1 and comprises a liquid developer container 2 and a liquid developer distributor 3. The liquid developer container 2 holds a liquid developer with toner particles dispersed therein. The developer is stirred by a stirrer 4 and is sucked by a pump 5, so that it is supplied into the liquid developer distributor 3 through hoses 16.

Figure 2:
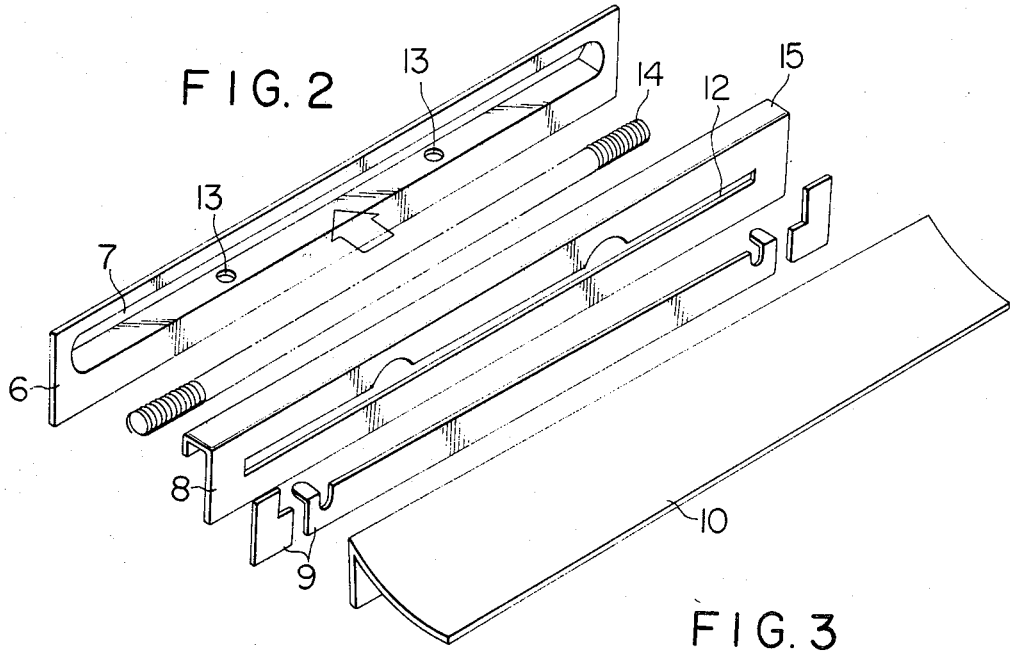
FIG. 2 is a fragmentary perspective view of a developer distributor to be assembled in the development apparatus of FIG. 1.
Figure 3:
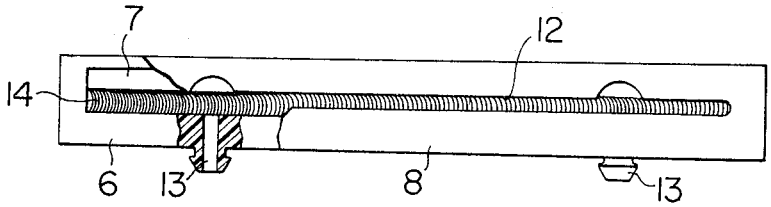
FIG. 3 is a schematic side view of the developer distributor of FIG. 1, wherein a spacer and an electrode are detached from the developer distributor and a partial sectional view of a developer inlet is shown.

As illustrated in more detail in FIGS. 2 and 3, the developer distributor 3 is shaped like a long and narrow container extending in the axial direction of the photoconductor drum 1. In the present embodiment, the developer distributor 3 comprises a container body 6, having a manifold chamber concave portion, a partition wall 8, a spacer 9, and an electrode plate 10. Between the partition wall 8 and electrode plate 10 having a shelf portion spaced from the drum, there is formed a well 11, which is directed to the surface of the photoconductor drum 1 for impinging the developer against the surface of the drum 1. The well 11 extends over the full length of the drum 1 in the axial direction and the width of the well 11 is set by the thickness of the spacer 9. The concave portion of the container body 6 is closed by the partition wall 8 having outlet means or an opening 12 which is connected to the well 11, whereby a manifold or surge-chamber 7 is separately formed. The developer is fed into the surge-chamber 7 from two developer inlets 13 formed in the container body 6 to which the hoses 16 are connected.

Inside the surge-chamber 7, there is disposed a coil buffer 14. The coil buffer 14, which can be made of a coil, is disposed over the full length of the surge-chamber 7 in the longitudinal direction. The pitch and diameter of the coil of the coil buffer 14 may be different in accordance with the development conditions, such as the flow speed and flow rate of developer, but under the ordinary condition with a 3l/min flow rate of developer, it is preferable to set the coil pitch at 2 mm and the coil diameter at approximately 0.3 mm.

In the present embodiment, the partition wall 8 extends, with a predetermined space maintained from the surface of the photoconductor drum 1, in the axial direction of the drum 1 and is disposed behind the well 11, viewed from the rotating direction of the drum 1 and constitutes an auxiliary electrode plate 15, while the electrode plate 10 is disposed in front of the well 11, viewed from the rotating direction of the drum 1 and extends in the axial direction of the drum 1 with a predetermined space maintained from the surface of the drum 1.

In the above-mentioned construction, the developer sucked by the pump 5 is fed into the surge-chamber 7 of the developer distributor 3 from the developer inlets 13 through the hoses 16 and is conveyed to the opening 12, passing across the coil buffer 14, namely through the gaps of the coil pitch of the coil buffer 14, and is then impinged against the surface of the drum 1 from the well 11 disposed between the auxiliary electrode plate 15 and electrode plate 10. At this moment, the developer, which has been fed into the surge-chamber 7 from the developer inlets 13, receives a resistance from the coil buffer 14 while passing across the coil buffer 14, so that the force of making the developer flow in the axial direction of the drum 1 is dismissed, whereby the developer is impinged against the surface of the drum 1 uniformly from the whole range of the well 11. Thus, the developer is uniformly supplied onto the surface of the drum 1, so that local insufficient development of latent images on the drum 1 can be obviated.

Of the developer impinging on the surface of the drum 1 from the well 11, the unused developer is overflown from the end of the electrode plate 10 or from the end of the auxiliary electrode plate 15 and is recovered into the liquid developer container 2.

While the specific embodiment of the invention has been shown in detail to illustrate the application of the principles of the invention, it will be understood that the invention may be embodied otherwise without departing from such principles.

What is claimed is:

1. A development apparatus for use with an electrophotographic copying machine employing a liquid developer, comprising a liquid developer distributor having developer impingement means with at least one outlet for impinging a liquid developer against the surface of a latent electrostatic image bearing photoconductor so as to cover the latent image area, developer inlet means with at least one inlet for introducing the liquid developer into said liquid developer distributor and developer buffer means comprising at least one coil extending between said outlet of said developer impingement means and said developer inlet means whereby said liquid developer passes through said coil.

2. A development apparatus as claimed in claim 1, wherein said liquid developer distributor is shaped like a long and narrow container extending in the longitudinal direction of said photoconductor comprising, in combination, a first wall and a second wall which are disposed approximately at a right angle, said first wall having said developer inlet, and said second wall having said outlet.

3. A development apparatus as claimed in claim 2, said first wall has a concave portion for allowing said developer buffer means to place therein and said developer inlet means is disposed in said concave portion.

4. A development apparatus as claimed in claim 2, wherein said outlet shaped like a slit formed in longitudinal direction of said photoconductor.

5. A development apparatus as claimed in claim 2, wherein said developer impingement means comprises a plurality of slits arranged in the longitudinal direction of said photoconductor.

6. A development apparatus as claimed in claim 2, further comprising an electrode plate having a buffer wall and an electrode wall extending in the longitudinal direction of said photoconductor, said buffer wall facing said outlet so as to form a well for impinging the developer on said photoconductor between said second wall and said buffer wall, and said electrode wall disposed along the surface of said photoconductor with a predetermined space.

7. A developer apparatus as claimed in claim 6, said well is arranged in the longitudinal direction of said photoconductor so as to cover the latent image area of said photoconductor.

8. A developer apparatus as claimed in claim 6, said well is positioned upper stream of said photoconductor, viewed from the lowest point of said photoconductor.

9. A development apparatus for use in an electrophotographic copying machine having a photoconductor drum bearing a latent electrostatic image, a container for a liquid developer, and a developer distributing means having an inlet and an outlet; the improvement of said distributing means including a manifold chamber extending in a direction longitudinally of said drum, said inlet being in communication with said manifold chamber for introducing a liquid developer into said chamber, and a coil shaped developer buffer disposed in said manifold chamber, said coil buffer extending longitudinally within said chamber, and said coil buffer being disposed between said inlet and said outlet whereby said liquid developer passes through said coil.

10. A development apparatus as defined in claim 9 wherein said manifold chamber includes a container body including said manifold chamber, a partition wall, an electrode plate spaced from said partition wall to define a well extending substantially co-extensive the length of said manifold chamber, said well being open at one end to define an outlet extending longitudinally of said drum, and said partition wall having an elongated opening therein for connecting said manifold chamber in communication with said well, said coil buffer being disposed in said manifold chamber between said inlet and said partition wall.

11. A developing apparatus as defined in claim 10 wherein said electrode plate includes a curvilinear shelf corresponding to the curvature of said drum and which shelf is spaced therefrom.

12. A developing apparatus as defined in claim 11 wherein said shelf extends in the direction of rotation of said drum.

13. A developing apparatus as defined in claim 11 wherein said partition wall includes an auxiliary electrode plate, said auxiliary electrode plate being spaced from said drum and said auxiliary electrode plate extending in a direction opposite to the rotation of said drum.

14. A developing apparatus as defined in claim 11 wherein said partition wall includes an auxiliary electrode plate, wherein said shelf and auxiliary electrode are disposed on opposite sides of said wall outlet and in spaced relationship to said drum.

15. A developing apparatus for use with photoconductor drum bearing a latent electrostatic image in an electrophotographic copying machine comprising means defining an elongated manifold chamber, inlet means for introducing a developing liquid into said manifold chamber, means defining an outlet for said chamber, said outlet extending longitudinally of said chamber for discharging said developing liquid transversely onto said drum, a coil shaped buffer extending longitudinally within said chamber whereby said liquid developer passes through the gaps of the coil pitch of the coil buffer for effecting a uniformdistribution of said developing liquid from said outlet means, and pump means for supplying developing liquid to said inlet means.

16. A developing apparatus as defined in claim 15 wherein said coil buffer includes a helically wound member having a series of spaced apart convolutions.

17. A developing apparatus as defined in claim 16, wherein in convolutions of said coils have a pitch of approximately 2 mm and a diameter of 0.3 mm and the flow of developer from said pump means is at a rate of approximately 3 1/min.

18. A developing apparatus as defined in claim 16 wherein the convolutions of said coils have a pitch of approximately 2 mm. and a diameter of 0.3 mm.

19. A developing apparatus as defined in claim 15 wherein said outlet means comprises a well portion extending longitudinally of said chamber, said well being open at one end to define an outlet opening, and a partition wall separating said well portion from said manifold chamber, said partition having an elongated opening communicating said manifold chamber with said well portion, and said coil buffer being disposed in said manifold chamber between said inlet and the opening in said partition wall.

20. A developing apparatus as defined in claim 19 wherein said well portion includes an electrode plate spaced from said partition wall, and said electrode plate having a shelf portion spaced from said drum and extending in the direction of rotation of said drum.

21. A developing apparatus as defined in claim 20 wherein said partition includes an auxiliary electrode, said auxiliary electrode being spaced from said drum and extends in a direction opposite to said shelf portion.

* * * * *